US007241077B2

(12) United States Patent
Webster et al.

(10) Patent No.: US 7,241,077 B2
(45) Date of Patent: Jul. 10, 2007

(54) UNDERWATER INSTALLATION APPARATUS

(75) Inventors: David Webster, Monmouth (GB); Phillip Tarr, Bristol (GB)

(73) Assignee: Vetco Gray Controls Limited, Nailsea, Bristol (GB)

( * ) Notice: Subject to any disclaimer, the term of this patent is extended or adjusted under 35 U.S.C. 154(b) by 0 days.

(21) Appl. No.: 11/048,142

(22) Filed: Feb. 1, 2005

(65) Prior Publication Data

US 2005/0167117 A1 Aug. 4, 2005

(30) Foreign Application Priority Data

Feb. 4, 2004 (GB) ..... 0402415.4

(51) Int. Cl.
*E21B 33/076* (2006.01)

(52) U.S. Cl. ..... 405/195.1; 166/355

(58) Field of Classification Search ..... 405/195.1, 405/205; 166/351, 355
See application file for complete search history.

(56) References Cited

U.S. PATENT DOCUMENTS 2,855,685 A * 10/1958 Barreteau ..... 33/834
3,532,162 A * 10/1970 Fischer ..... 166/360
4,702,320 A * 10/1987 Gano et al. ..... 166/343
4,883,388 A * 11/1989 Cherbonnier ..... 405/195.1
4,886,397 A * 12/1989 Cherbonnier ..... 405/195.1
5,190,107 A * 3/1993 Langner et al. ..... 166/355
2005/0167117 A1* 8/2005 Webster et al. ..... 166/355

FOREIGN PATENT DOCUMENTS

GB 2371581 A 7/2002

* cited by examiner

*Primary Examiner*—Tara L. Mayo
(74) *Attorney, Agent, or Firm*—Bracewell & Giuliani LLP

(57) ABSTRACT

A running tool for deployment from a base such as a vessel for installing a component at an underwater facility such as a hydrocarbon extraction well includes a carriage which is lowered from the base. The carriage releasably retains the component. A compensator is located between the carriage and the base for compensating for relative motion between the underwater facility and the base.

14 Claims, 4 Drawing Sheets

UNDERWATER INSTALLATION APPARATUS

CROSS-REFERENCE TO RELATED APPLICATION

This application claims the benefit of United Kingdom Patent Application No. 0402415.4, filed on Feb. 4, 2004, which hereby is incorporated by reference in its entirety.

FIELD OF THE INVENTION

This invention concerns an apparatus and a method for facilitating the installation of a component at an underwater facility, such as a hydrocarbon production facility or well.

BACKGROUND OF THE INVENTION

The installation of equipment for subsea fluid extraction wells involves the lowering of heavy assemblies onto the sea bed. It is particularly difficult to lower components such as subsea control modules to locate on structures already on the sea bed, such as a well tree, as considerable positional accuracy is required. The lowering of such components is normally effected from a surface vessel, in conjunction with the use of a subsea remote operated vehicle (ROV). However, the surface vessel is subjected to the conditions of the surface sea state, causing the vessel to move in pitch, yaw and heave. The effects of pitch and heave are minimised by the use of vessels which are purpose designed to allow lowering from a special access in the center of the vessel. However since the availability of such vessels is limited, their use is expensive. It is therefore desirable to use a "vessel of opportunity" i.e. one which is not purpose designed for this work, in conjunction with the ROV, thus increasing the availability of vessels suitable for installation and so substantially reducing costs for the operator.

SUMMARY OF THE INVENTION

It is an object of the present invention to provide installation apparatus which may be deployed from a general surface vessel, i.e. one which is not purpose-built for such work.

In accordance with a first aspect of the present invention there is provided an apparatus for deployment from a base for installing a component at an underwater facility, comprising a carriage lowered from the base in use of the apparatus, the carriage being adapted to releasably retain the component and compensation means located between the carriage and the base in use for compensating for relative motion between the underwater facility and the base.

Preferably, a cable is used for suspending the carriage from the base, and the compensation means is located between the cable and the carriage.

The compensation means may comprise a resiliently deformable member, such as a spring. The resiliently deformable member may be provided within a parallelogram linkage.

Preferably, the carriage is provided with guide cables for engaging with the underwater facility, to provide a guide for locating the component at the underwater facility. In this case, the compensation means would act to keep the guide cables tensioned during installation of the component substantially regardless of said relative motion. Advantageously, the guide cables are manipulable by a remotely operated vehicle to engage with the underwater facility.

The carriage may be provided with a retractable cable for engaging with the component. This retractable cable is preferably manipulable by a remotely operated vehicle to engage with the component.

According to a second aspect of the present invention, there is provided a method of installing a component at an underwater facility comprising the steps of providing a base, lowering installation apparatus from the base, the apparatus comprising a carriage which releasably retains the component, and compensating for relative motion between the base and the underwater facility using compensation means located between the carriage and the base.

The base is preferably a surface vessel.

The underwater facility may be a hydrocarbon extraction facility.

BRIEF DESCRIPTION OF THE DRAWINGS

The invention will now be described by way of example with reference to the following figures, in which.

DESCRIPTION OF PREFERRED EMBODIMENTS

Figure 1:
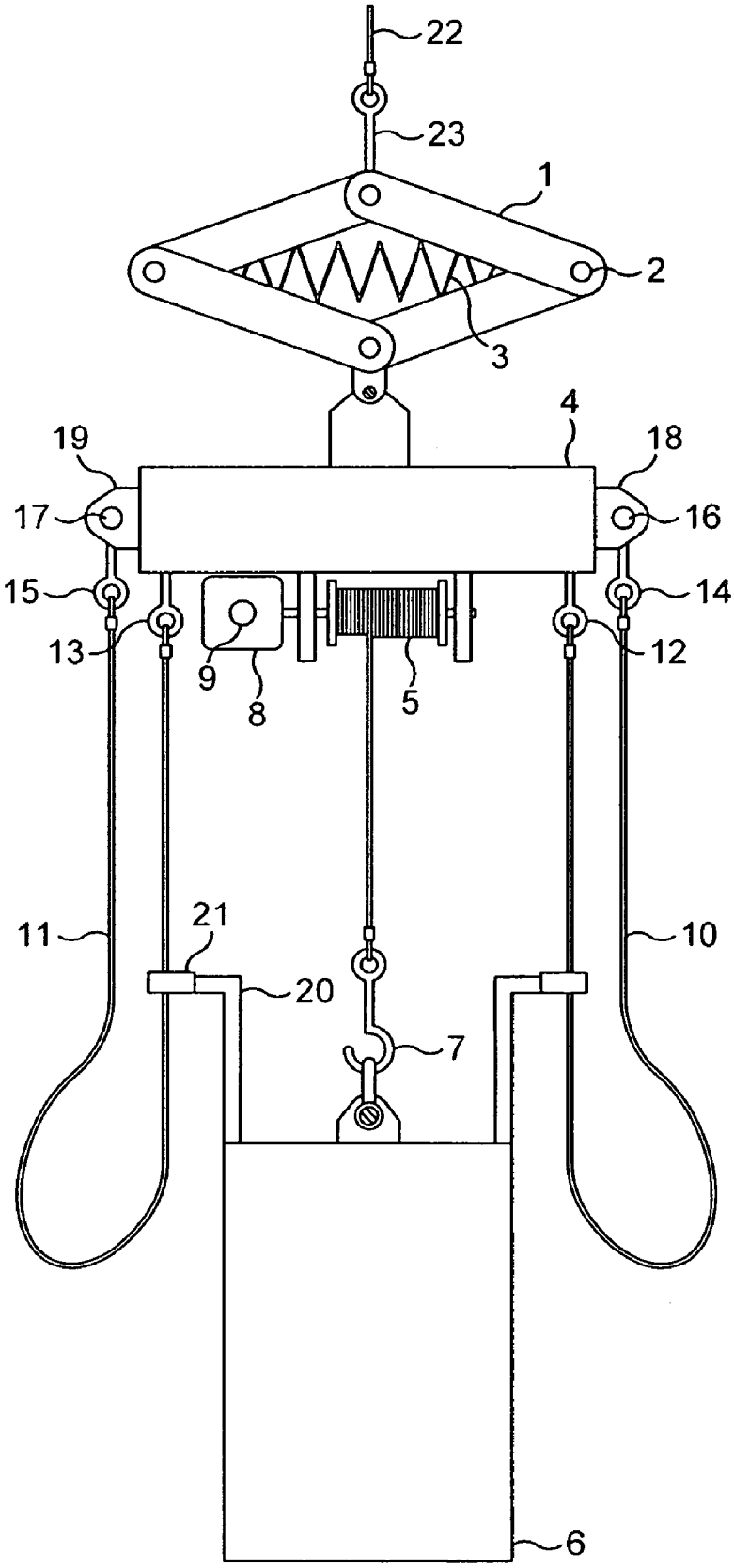
FIG. 1 shows an embodiment of the apparatus of the present invention, arranged for the lowering of a production module to the sea bed.

Referring first to FIG. 1, a first embodiment of the inventive apparatus comprises a spring-loaded compensation mechanism supporting a carriage comprising a winch and guide cable assembly, the whole constituting a 'deployment stack'. The compensation mechanism consists of a parallelogram linkage with four arms 1 connected to each other at their ends by four pivot bearings 2, and held in the relaxed position shown by a compression spring 3 attached in the proximity of two of the pivot bearings 2. As the parallelogram linkage is in the form of a pantograph, the linked arms are capable of 'scissor' movement to change the length of the mechanism within set limits. The mechanism is attached to a carriage comprising a beam 4, which carries a winch 5, the cable of which is attached to the module 6 to be installed by a hook 7. In the example shown, the module is a subsea control module, although any modules or components are suitable. The winch 5 is driven by a gearbox 8. An input shaft 9 of the gearbox 8 is designed to be easily engaged with and operated by a remote operated vehicle (ROV), i.e. it is 'ROV-friendly'. Two guide cables 10 and 11 are attached to anchor points 12 and 13, which in turn are attached to the beam 4. These guide cables 10 and 11 may be permanently attached to the anchor points 12 and 13 or advantageously may be attached via shackles (not shown) to facilitate easy replacement if required. The other ends of the guide cables 10 and 11 are attached to hooks 14 and 15 which are removably hooked at each end of the beam 4 on short rods 16 and 17 mounted on trunnions 18 and 19, so that they can be easily detached by an ROV during installation of the module 6. The module to be installed 6 is fitted with two guide arms 20, terminated with collars 21. During the setting up of the apparatus, the guide cables 10 and 11 are passed through the collars 21. Typically, the two guide arms and collars are an integral feature of the module to be installed, but could be detachable. The weight of the module 6 with the carriage is insufficient to significantly extend the compensation mechanism and compress the spring 3.

The use of the apparatus is now described with reference to FIGS. 1 to 3.

FIG. 1 shows the deployment stack attached to the module to be installed, set up for lowering through the sea towards the sea bed. The whole apparatus is attached to a crane on a deployment vessel of opportunity via the cable 22 and hook 23, hooked onto the pivot between the upper arms of the compensation mechanism.

Figure 2:
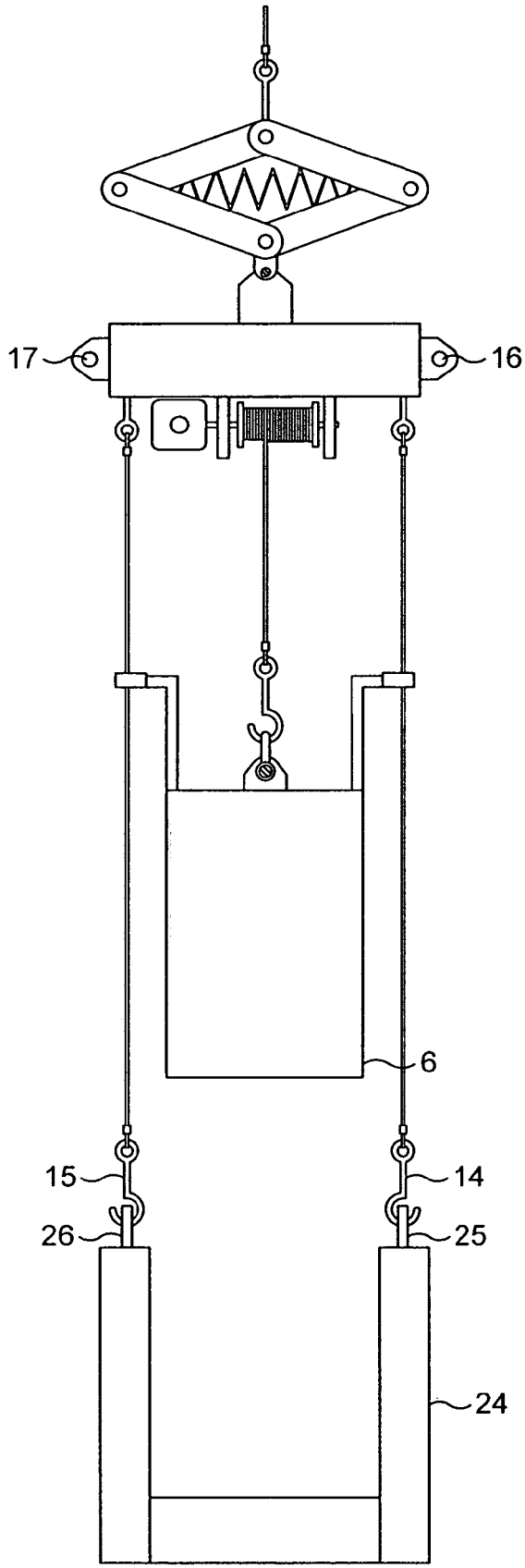
FIG. 2 shows the apparatus attached to an underwater facility located on the sea bed.

The next step in installation is illustrated in FIG. 2, which shows the deployment stack and module lowered close to equipment 24 of a facility, typically a well tree, located on the sea bed. This equipment is shown much simplified and has been restricted in the figure to solely show a location for the module to be installed. The hooks 14 and 15 on the ends of the guide cables 10 and 11 are detached by an ROV from the rods 16 and 17, and reattached to anchor points 25 and 26 fitted to the subsea equipment 24.

Figure 3:
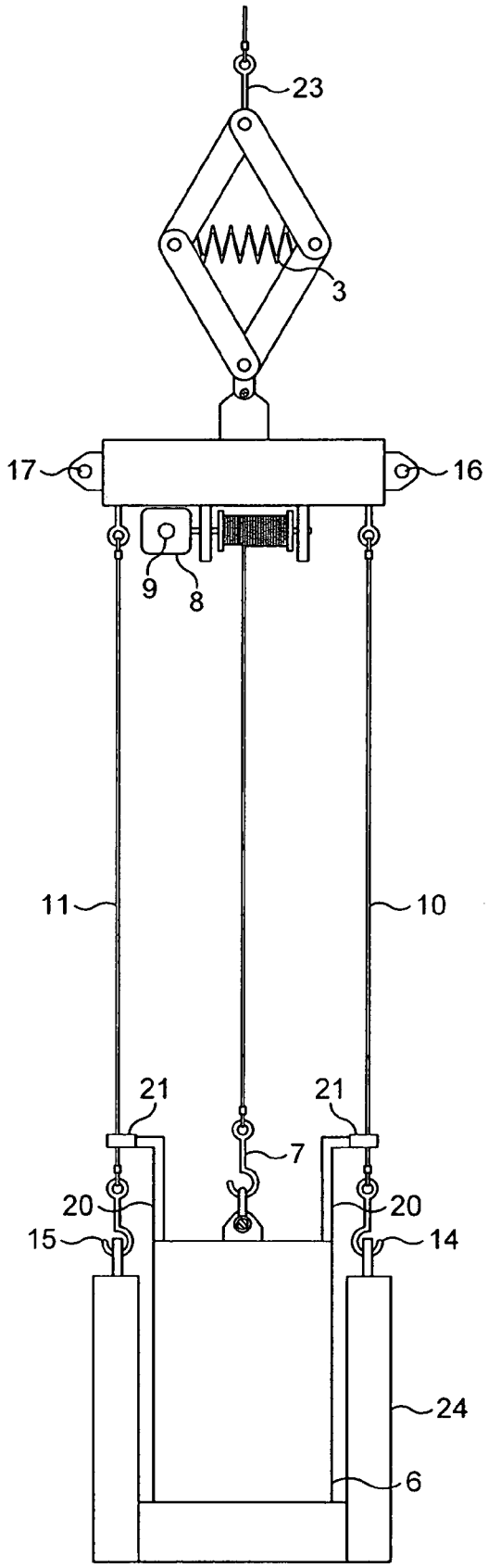
FIG. 3 shows the apparatus after installation of the production module.

The final step in installation is shown in FIG. 3. The deployment stack is hoisted upwards by the crane on the deployment vessel, thus lifting the crane hook 23 and resulting in a vertical extension of the compensation mechanism and tightening of the guide cables 10 and 11, which are kept tensioned by the compression of the spring 3. The apparatus is hoisted vertically just sufficiently to provide tension in the guide cables 10 and 11 at both the peaks and troughs of the vessel heave motion. Thus the compensation mechanism provides compensation for the deployment vessel heave during the rest of the installation phase. Because a parallelogram linkage is used rather than merely incorporating a simple spring in the cable, the spring cannot be over-extended and thus damaged, and also the maximum heave compensation amplitude is known, being delimited by the length of the arms 1. Once the correct condition has been established, the ROV engages with the input shaft 9 of the winch gearbox 8, and by rotating the shaft 9 lowers the module 6 into the sea bed equipment 24. Alignment of the module 6 into the sea bed equipment 22 is facilitated by the collars 21 attached to the module 6 via the arms 20, running down the tensioned guide cables 10 and 11 as the module 6 is lowered into position. After correct location of the module, the crane on the deployment vessel lowers the deployment stack sufficiently for the ROV to detach the hooks 7, 14 and 15, thus allowing recovery of the stack for further use.

Figure 4:
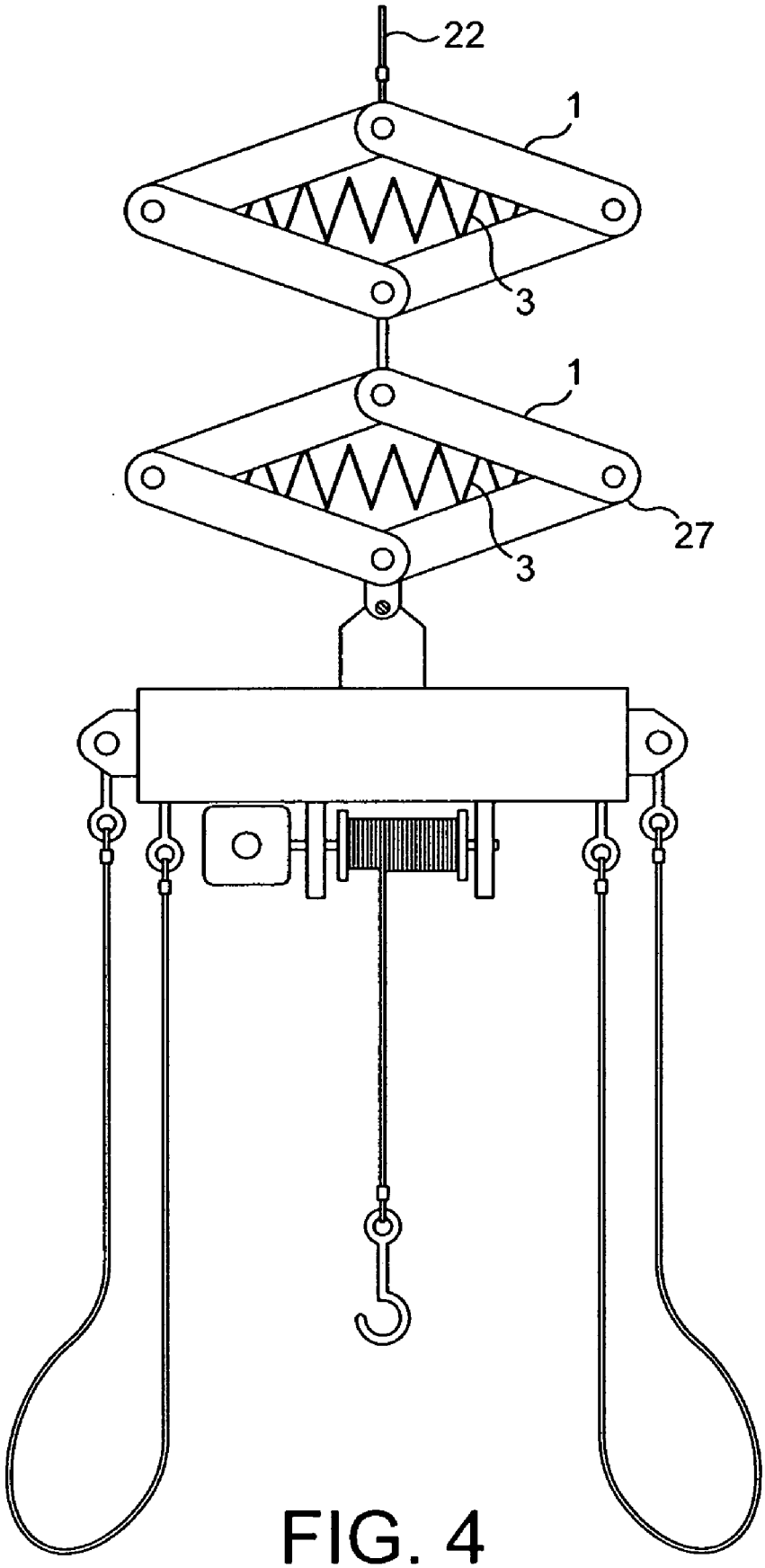
FIG. 4 shows a second embodiment of the invention, with additional heave capacity.

The amplitude of heave that the compensation mechanism can accommodate is limited by the length of the arms. However, in circumstances where a greater amplitude of heave must be accommodated, then as illustrated in FIG. 4 a second compensation mechanism 27 can be added to the installation apparatus. Indeed, further compensation mechanisms can be added to the apparatus to accommodate even greater amplitudes of heave.

Thus the invention provides compensation for the heave of the deployment vessel so that vessels of opportunity can be used to install subsea well production equipment. In practice, the apparatus will allow deployment from the stem of the vessel where the heave is greater than the vessel center, but the convenience in installation is often greater. It should also be noted that, bearing in mind the substantial depths of subsea wells, the alignment guidance features of the apparatus greatly facilitate the alignment of modules with the subsea well head equipment during the installation process. This greatly reduces the activity required from the ROV and the problems resulting from the various movements of the deployment vessel, thus reducing installation time and cost.

Although the invention has been described with reference to the embodiments above, there are many other modifications and alternatives possible within the scope of the claims. For example, rather than using a horizontally-orientated compression spring 3 within the parallelogram linkage, it is possible to use a vertically-orientated extension spring connected at the other two pivot bearings 2. The compensation means is shown as being proximate to the carriage, but may be located at any position between the carriage and the vessel. The compensation means is shown as including a parallelogram linkage, but other configurations using arms of differing lengths are possible.

The invention claimed is:

1. An apparatus for deployment from a base for installing a component at an underwater facility, comprising a carriage lowered from the base in use of the apparatus, the carriage being adapted to releasably retain the component, a compensator located between the carriage and the base in use for compensating for relative motion between the underwater facility and the base, and a suspension cable for suspending the carriage from the base, wherein the compensator comprises a plurality of arms pivotably connected to the cable; wherein the arms are connected to a resiliently deformable member; and wherein the arms are pivotally connected together to define a parallelogram linkage having four pivot bearings, and the resiliently deformable member is connected between two of the pivot bearings.

2. The apparatus according to claim 1, wherein the compensator is located between the suspension cable and the carriage.

3. The apparatus according to claim 1, wherein the resiliently deformable member is a spring.

4. The apparatus according to claim 1, wherein the carriage is provided with guide cables for engaging with the underwater facility.

5. The apparatus according to claim 4, wherein the guide cables when engaged with the underwater facility provide a guide for locating the component at the underwater facility.

6. The apparatus according to claim 4, wherein the compensator acts to keep the guide cables tensioned during installation of the component substantially regardless of said relative motion.

7. The apparatus according to claim 4, wherein the guide cables are manipulable by a remotely operated vehicle to engage with the underwater facility.

8. An apparatus for deployment from a base for installing a component at an underwater facility, comprising a carriage lowered from the base in use of the apparatus, the carriage being adapted to releasably retain the component, a compensator located between the carriage and the base in use for compensating for relative motion between the underwater facility and the base, and a suspension cable for suspending the carriage from the base, wherein the compensator comprises a plurality of arms pivotably connected to the cable; and wherein the carriage is provided with a retractable cable for engaging with the component.

9. The apparatus according to claim 8, wherein the retractable cable is manipulable by a remotely operated vehicle to engage with the component.

10. An apparatus for deployment from a floating vessel for installing a component at an underwater facility, comprising:

a suspension cable adapted to be lowered from the vessel for installing the component at the underwater facility;

a wave motion compensator having first and second ends movable relative to each other between a retracted position and an extended position in response to wave movement, the first and second ends being biased toward the retracted position, the first end being connected to the suspension cable to allow the suspension cable to move upward and downward relative to the second end of the compensator in response to wave movement; and a carriage connected to the second end of the compensator, the carriage having an engaging member that releasably retains the component with the carriage as the carriage is being lowered with the suspension cable toward the underwater facility.

11. The apparatus according to claim 10, wherein the compensator comprises:

four linkage bars pivotally connected together in an arrangement having an upper pivot point, a lower pivot point and two lateral pivot points, the upper pivot point being the first end of the compensator and the lower pivot point being the second end of the compensator; and a spring member connected between the lateral pivot points and urging them apart from each other.

12. The apparatus according to claim 11, further comprising:

a pair of guide lines for guiding movement of the component from the carriage to the underwater facility, each of the guidelines having a first end connected to an opposite side of the carriage and a releasable coupling on a second end for connection to the underwater facility when the carriage is a selected distance away from the underwater facility, the selected distance being substantially the same as the length of the guide lines.

13. The apparatus according to claim 10, wherein the engaging member comprises:

a winch mounted to the carriage;

a deployment cable wound around the winch and having a free end for connection to the component.

14. The apparatus according to claim 12, wherein each of the couplings has a storage position releasably connected to the carriage, defining a loop for each of the guidelines while the carriage is being lowered toward the underwater facility.

* * * * *